US009293308B2

(12) United States Patent
Nagata et al.

(10) Patent No.: US 9,293,308 B2
(45) Date of Patent: Mar. 22, 2016

(54) ELECTRON TUBE

(71) Applicant: HAMAMATSU PHOTONICS K.K., Hamamatsu-shi, Shizuoka (JP)

(72) Inventors: Takaaki Nagata, Hamamatsu (JP); Yasumasa Hamana, Hamamatsu (JP); Kimitsugu Nakamura, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 14/425,810

(22) PCT Filed: Jul. 31, 2013

(86) PCT No.: PCT/JP2013/070736
§ 371 (c)(1),
(2) Date: Mar. 4, 2015

(87) PCT Pub. No.: WO2014/038318
PCT Pub. Date: Mar. 13, 2014

(65) Prior Publication Data

US 2015/0235825 A1 Aug. 20, 2015

(30) Foreign Application Priority Data

Sep. 5, 2012 (JP) ..... 2012-195219

(51) Int. Cl.
*H01J 43/18* (2006.01)
*H01J 43/28* (2006.01)

(52) U.S. Cl.
CPC *H01J 43/18* (2013.01); *H01J 43/28* (2013.01)

(58) Field of Classification Search
CPC ..... H01J 43/18; H01J 43/00; H01J 43/02; H01J 43/28
USPC ..... 313/533, 532, 103 R, 104
See application file for complete search history.

(56) References Cited

U.S. PATENT DOCUMENTS 4,604,545 A 8/1986 McDonie et al.

FOREIGN PATENT DOCUMENTS

| | | | |
|---|---|---|---|
| JP | S50-112053 | U | 2/1974 |
| JP | H51-131263 | A | 11/1976 |
| JP | S58-005319 | Y2 | 1/1983 |
| JP | H02-227946 | A | 9/1990 |
| JP | H09-265923 | A | 10/1997 |
| JP | 2002-080828 | A | 3/2002 |

(Continued)

OTHER PUBLICATIONS

English-language translation of International Preliminary Report on Patentability (IPRP) dated Mar. 19, 2015 that issued in WO Patent Application No. PCT/JP2013/070735.

(Continued)

*Primary Examiner* — Vip Patel
(74) *Attorney, Agent, or Firm* — Drinker Biddle & Reath LLP

(57) ABSTRACT

In an electron tube, an electrical resistance film having a stacked structure of electrically insulating layers and electrically conductive layers is formed on holding surfaces of bases in insulating substrates. This electrical resistance film is made as a firm and fine film with a desired resistance by use of an atomic layer deposition method, which can suppress electrification of the bases comprised of an insulating material. This makes it feasible to stably maintain withstand voltage characteristics.

10 Claims, 4 Drawing Sheets

(56) References Cited

FOREIGN PATENT DOCUMENTS

| | | | |
|---|---|---|---|
| JP | 2003-226970 | A | 8/2003 |
| JP | 2010-199449 | A | 9/2010 |
| JP | 2010-267414 | A | 11/2010 |
| JP | 2011-501877 | A | 1/2011 |
| JP | 2011-082301 | A | 4/2011 |
| JP | 2012-094660 | A | 5/2012 |

OTHER PUBLICATIONS

English-language translation of International Preliminary Report on Patentability (IPRP) dated Mar. 19, 2015 that issued in WO Patent Application No. PCT/JP2013/070736.

U.S. Appl. No. 14/425,917, Hamamatsu Photonics K.K.

*Fig.3*

| | HYSTERESIS [%] | | | |
|---|---|---|---|---|
| COMPARATIVE EXAMPLE | -3.57 | -5.33 | -3.34 | -5.61 |
| EXAMPLE | 0.63 | -0.7 | --- | --- |

ELECTRON TUBE

TECHNICAL FIELD

The present invention relates to an electron tube.

BACKGROUND ART

There is a conventional electron tube wherein, for example, an insulating substrate holding electrodes is housed in a housing. In the electron tube of this kind, if electrons are incident into the insulating substrate holding the electrodes to electrify the substrate, it may result in degradation of withstand voltage characteristics between the electrodes. For improving the withstand voltage characteristics, for example in the case of the photomultiplier described in Patent Literature 1, chrome oxide is applied onto the surface of the ceramic substrate and then fired to form a chrome oxide film.

CITATION LIST

Patent Literature

Patent Literature 1: U.S. Pat. No. 4,604,545

SUMMARY OF INVENTION

Technical Problem

As a material property, chrome oxide has a value enough to improve the withstand voltage characteristics, but, since in the above-described conventional technology the chrome oxide film was formed by attaching the material by application and then firing it, there were cases where a substance (e.g., binder) unnecessary for the chrome oxide film existed heterogeneously in the film because of its manufacturing process, failing to obtain a desired resistance.

The present invention has been accomplished in order to solve the above problem and it is an object of the present invention to provide an electron tube capable of stably maintaining the withstand voltage characteristics.

Solution to Problem

In order to solve the above problem, an electron tube according to the present invention comprises: a plurality of electrodes; an insulating holding portion for holding the electrodes in an electrically isolated state; and a housing for housing the electrodes and the insulating holding portion, wherein the insulating holding portion has a base comprised of an insulating material, and an electrical resistance film formed on an electrode holding surface in the base, and wherein the electrical resistance film has a stacked structure of an electrically insulating layer and an electrically conductive layer formed by an atomic layer deposition method.

In this electron tube, the electrical resistance film having the stacked structure of the electrically insulating layer and the electrically conductive layer is formed on the electrode holding surface in the base of the insulating holding portion. By use of the atomic layer deposition method, this electrical resistance film is made as a firm and fine film with a desired resistance, which can suppress electrification on the holding surface of the base comprised of the insulating material. This makes it feasible to stably maintain the withstand voltage characteristics. Furthermore, it suppresses discharge of gas from the base and electrification thereof, so as to suppress occurrence of withstand voltage failure as well.

Another electron tube according to the present invention comprises: a plurality of electrodes; an insulating holding portion for holding the electrodes in an electrically isolated state; and a housing for housing the electrodes and the insulating holding portion, wherein the insulating holding portion has a base comprised of an insulating material, and an electrical resistance film formed on an electrode holding surface in the base, and wherein the electrical resistance film has a mixed structure of an electrically insulating material and an electrically conductive material formed by an atomic layer deposition method.

In this electron tube, the electrical resistance film having the mixed structure of the electrically insulating material and the electrically conductive material is formed on the electrode holding surface in the base of the insulating holding portion. By use of the atomic layer deposition method, this electrical resistance film is made as a firm and fine film with a desired resistance, which can suppress electrification on the holding surface of the base comprised of the insulating material. This makes it feasible to stably maintain the withstand voltage characteristics. Furthermore, it suppresses discharge of gas from the base and electrification thereof, so as to suppress occurrence of withstand voltage failure as well.

Preferably, the electrical resistance film is formed across an entire area of the base. This uniformizes electrical characteristics in the entire area of the base and makes it feasible to more stably maintain the withstand voltage characteristics.

Preferably, the electrically insulating material used for formation of the electrical resistance film is a metal oxide. Since the metal oxide has excellent chemical stability, use of the metal oxide as the electrically insulating material leads to suppression of temporal change in resistance of the electrical resistance film.

Preferably, the electrically conductive material used for formation of the electrical resistance film is a metal oxide. Since the metal oxide has excellent chemical stability, use of the metal oxide as the electrically conductive material leads to suppression of temporal change in resistance of the electrical resistance film.

Preferably, the electron tube comprises a photocathode for converting incident light into photoelectrons; the electrodes are electrodes of a multiplication unit for multiplying the photoelectrons generated in the photocathode. For example, in the electron tube with the photocathode and multiplication unit like a photomultiplier, the insulating holding portion holding the electrodes is likely to become electrically charged by multiplied secondary electrons and degradation of withstand voltage characteristics between the electrodes significantly affects detection characteristics. Therefore, it is particularly useful to form the foregoing electrical resistance film on the holding surface.

Advantageous Effect of Invention

According to the present invention, the withstand voltage characteristics can be maintained on a stable basis.

BRIEF DESCRIPTION OF DRAWINGS

FIG. 3 is a drawing showing the measurement results of hysteresis characteristics of electron tubes according to Example and Comparative Example.

DESCRIPTION OF EMBODIMENTS

A preferred embodiment of the electron tube according to the present invention will be described below in detail with reference to the drawings.

Figure 1:
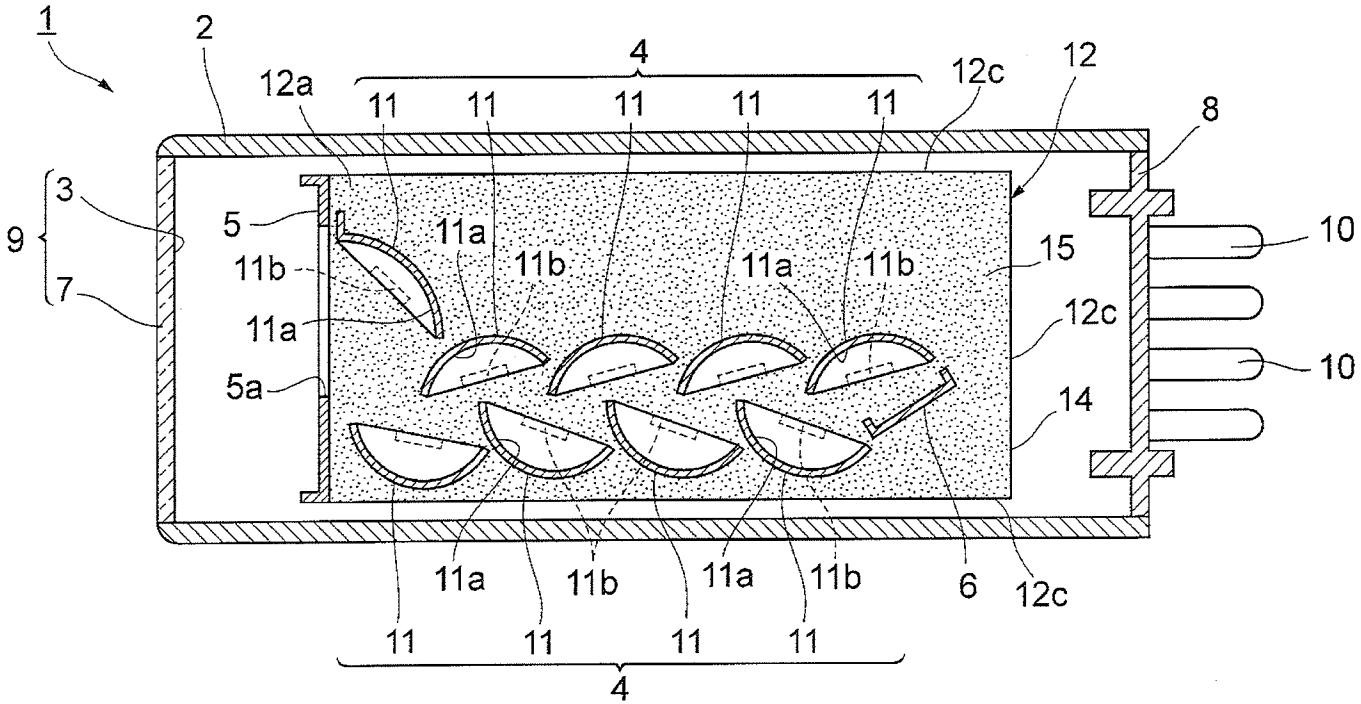
FIG. 1 is a cross-sectional view showing an internal configuration of an electron tube according to an embodiment of the present invention.

FIG. 1 is a cross-sectional view showing an internal configuration of an electron tube according to an embodiment of the present invention. As shown in the same drawing, the electron tube 1 is configured as a photomultiplier in which a photoelectron surface (photocathode) 3 for converting incident light into photoelectrons, a focusing electrode 5 for guiding the photoelectrons emitted from the photoelectron surface 3 to a multiplication unit 4, the multiplication unit 4 for implementing the secondary electron multiplication of the photoelectrons, and an anode 6 for collecting the secondary electrons resulting from the multiplication by the multiplication unit 4 are arranged in proximity inside a housing 2, for example, comprised of Kovar metal or glass.

The inside of the electron tube 1 is held in a high vacuum state while the two opening ends of the housing 2 of a substantially cylindrical shape opening at the two ends are hermetically sealed by an input window 7 of glass and a stem 8 of metal or glass. Namely, the housing 2, input window 7, and stem 8 constitute a vacuum vessel. The photoelectron surface 3 is formed on the vacuum-side surface of the input window 7. A photocathode 9 is constituted by these input window 7 and photoelectron surface 3. The stem 8 is provided with a plurality of stem pins 10 so as to penetrate it. The stem pins 10 are electrically connected to the photoelectron surface 3, to the focusing electrode 5, to the multiplication unit 4, and to the anode 6, respectively.

The focusing electrode 5 is, for example, of a cup shape and an opening 5*a* of a circular sectional shape is formed in a central portion thereof. The focusing electrode 5 is arranged so that the opening 5*a* is opposed to the photoelectron surface 3. The anode 6 is of a linear shape or tabular shape and is arranged on the rear stage side of the multiplication unit 4. It is noted that a mesh electrode may be disposed at the opening 5*a* of the focusing electrode 5 or between the anode 6 and the multiplication unit 4.

The multiplication unit 4 arranged between the focusing electrode 5 and the anode 6 is composed of multiple-stage dynodes (electrodes) 11 of a so-called line focus type. Each dynode 11 has a secondary electron surface 11*a* for implementing the secondary electron multiplication of photoelectrons. Each of the secondary electron surfaces 11*a* is of an arcuate sectional shape and the secondary electron surfaces 11*a*, 11*a* between adjacent dynodes 11, 11 are arranged so as to be opposed to each other. Applied to the first-stage dynode 11 is, for example, a negative potential of the same voltage as that of the focusing electrode 5, and applied to the nth-stage dynode 11 is a negative potential with an absolute value smaller than that to the (n−1)th-stage dynode 11. Furthermore, the potential of the anode 6 is set to 0 V.

Figure 2:
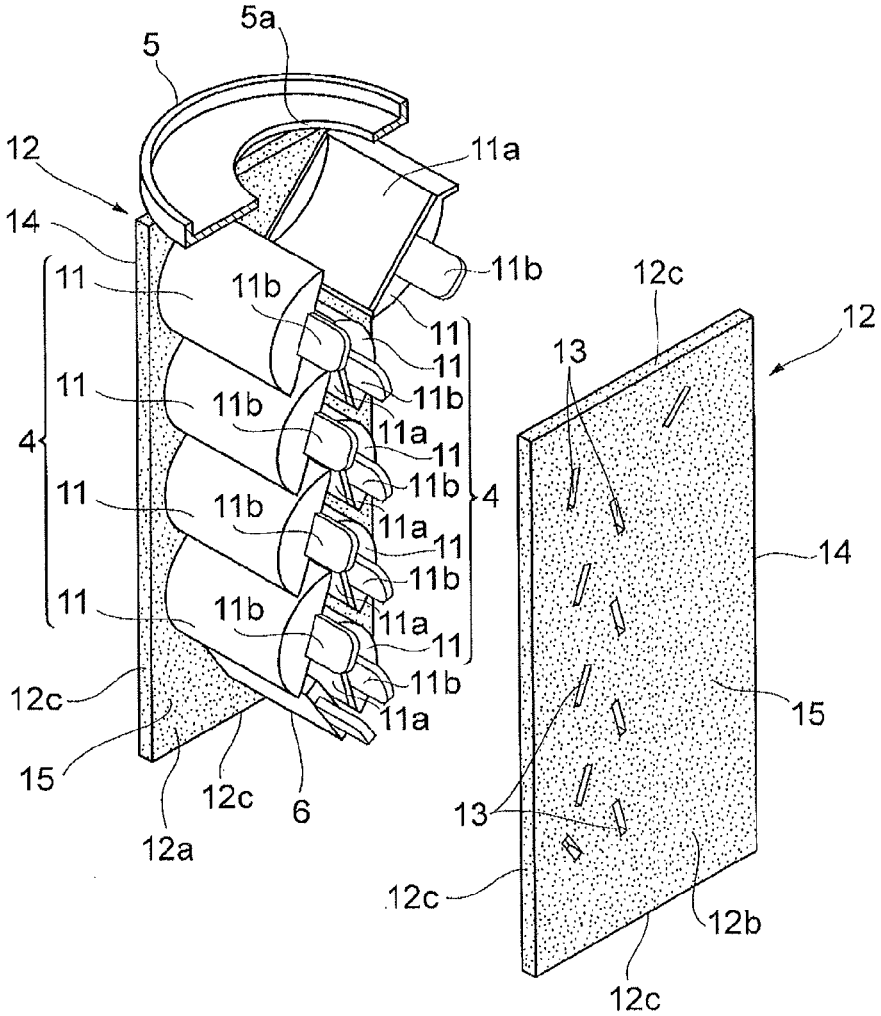
FIG. 2 is a perspective view of insulating substrates and a multiplication unit.

At the two ends in the longitudinal direction of each dynode 11 there are provided holding pieces 11*b* for holding the dynode 11 in the housing 2. For holding the dynodes 11 in the housing 2, a pair of insulating substrates (insulating holding portions) 12, 12 are used as shown in FIG. 2. Formed in this insulating substrate 12 are insertion slots 13 into which the holding pieces 11*b* of the dynodes can be inserted, and by inserting the corresponding holding pieces 11b of the dynodes into the insertion slots 13 and sandwiching the dynodes 11 between the insulating substrates 12, 12, the dynodes 11 are held in the housing 2. The anode 6 is also held in the same structure, The insulating substrate 12 has a base 14 comprised of an insulating material, and an electrical resistance film 15 formed on a holding surface 12*a* for the dynodes 11 in the base 14. The base 14 is formed, for example, of a ceramic or the like in a substantially rectangular shape. The electrical resistance film 15 is formed so as to cover the entire area of the base 14, i.e., so as to cover the holding surface 12*a*, opposite surface 12*b*, and side faces 12*c*. The electrical resistance film 15 is also formed over the entire area of inner wall faces of the insertion slots 13 and over the entire area of inner wall faces of the insertion slot for the anode 6. In the insulating substrate 12, as described above, the electrical resistance film 15 is formed over a region facing a space where the secondary electron multiplication is implemented, and over the contact portions with the dynodes 11 and the anode 6.

This electrical resistance film 15 is formed by the atomic layer deposition method (ALD: Atomic Layer Deposition). The atomic layer deposition method is a technique of repetitively carrying out an adsorption step of molecules of a compound, a film formation step by reaction, and a purge step of removing excess molecules, thereby to stack atomic layers one by one, so as to obtain a thin film.

Film formation cycles of the electrical resistance film 15 by use of the atomic layer deposition method include film formation cycles of an electrically insulating material and film formation cycles of an electrically conductive material. For example, in a case where the electrically insulating material is $Al_2O_3$ and the electrically conductive material is ZnO, a film formation cycle of $Al_2O_3$ includes, for example, an adsorption step of $H_2O$, a purge step of $H_2O$, an adsorption step of trimethyl aluminum, and a purge step of trimethyl aluminum carried out in this order. Furthermore, a film formation cycle of ZnO includes an adsorption step of $H_2O$, a purge step of $H_2O$, an adsorption step of diethyl zinc, and a purge step of diethyl zinc carried out in this order. The film formation cycles of $Al_2O_3$ and the film formation cycles of ZnO are repetitively executed approximately sixty times, for example, at an execution ratio of 4:1 (a ratio to execute four film formation cycles of $Al_2O_3$ and thereafter execute one film formation cycle of ZnO), thereby obtaining the electrical resistance film 15 in the thickness of about 300 Å.

The electrical resistance film 15 formed by the atomic layer deposition method usually has a stacked structure of $Al_2O_3$ layers (electrically insulating layers) and ZnO layers (electrically conductive layers), but it does not always have the stacked structure because of influence of heating or the like conducted in the whole manufacturing process of the electron tube 1; instead, it can have a mixed structure of $Al_2O_3$ (electrically insulating material) and ZnO (electrically conductive material) in some cases.

In the electron tube 1, as described above, the electrical resistance film 15 having the stacked structure of the electrically insulating layers and electrically conductive layers is formed on the holding surface 12*a* of the base 14 in the insulating substrate 12, By use of the atomic layer deposition method, this electrical resistance film 15 is made as a firm and fine film with a desired resistance and can suppress electrification of the base 14 comprised of the insulating material. This makes it feasible to stably maintain the withstand voltage characteristics. Furthermore, it also suppresses disturbance of the electric field in the housing 2, so as to reduce change in trajectories of electrons passing through the multiplication unit 4, thereby improving hysteresis characteristics. Since the problem of absorption of alkali is less likely to arise, different from the case where the electrical resistance film is formed by application or the like, the photoelectron surface 3 and others can be produced without use of a large amount of alkali, which can inhibit degradation of noise characteristics.

Furthermore, since the electrical resistance film 15 can be formed firmly and finely on the holding surface 12*a* of the base 14, occurrence of delamination can be suppressed compared to the case where the electrical resistance film is formed by application or the like. If delamination occurs, it can produce foreign matter in the housing 2 to cause withstand voltage failure. When the electrical resistance film is formed by application or the like, there are problems of increase in man-hours and time necessary for evacuation of gas adsorbing to film; in contrast, the electron tube 1 can circumvent these problems.

Furthermore, in the electron tube 1 the electrical resistance film 15 is formed over the entire area of the base 14 and is also formed over the entire area of the inner wall faces of the insertion slots 13 provided in the holding surface 12*a*. Therefore, discharge of gas from the base 14 of the ceramic is suppressed, whereby the degree of vacuum is maintained well inside the housing 2. In addition, electrification of the base 14 is also more effectively suppressed, so as to suppress the occurrence of withstand voltage failure of the electron tube 1 as well.

In the electron tube 1, metal oxides are used as the electrically insulating material and the electrically conductive material to be used for formation of the electrical resistance film 15. Since metal oxides have excellent chemical stability and ensure sufficient thermal resistance, the use of the metal oxides such as $Al_2O_3$ and ZnO described above as the electrically insulating material and the electrically conductive material leads to suppression of temporal change in resistance of the electrical resistance film 15.

FIG. 3 is a drawing showing the measurement results of hysteresis characteristics of electron tubes according to Example and Comparative Example. The measurement shown in the same drawing was to evaluate the hysteresis characteristics with the electron tubes (Example) using the insulating substrates wherein the electrical resistance film was formed so as to cover the entire area of each ceramic base and with the electron tubes (Comparative Example) using the insulating substrates without formation of the electrical resistance film on each ceramic base.

The hysteresis characteristics were evaluated by measuring a change ratio of output at a rise to steady output. When this change ratio is positive, it indicates that the output at a rise is higher than the steady output; when it is negative, it indicates that the output at a rise is lower than the steady output. The smaller an absolute value of this change ratio, the better the hysteresis characteristics.

As shown in FIG. 3, hystereses of four samples of Comparative Example were −3.57, −5.33, −3.34, and −5.61 and an average of their absolute values was 4.46. In contrast to it, hystereses of two samples of Example were 0.63 and −0.7 and an average of their absolute values was 0.67. Therefore, Example demonstrated the absolute value of hysteresis reduced to approximately one seventh and thus it was confirmed that the hysteresis characteristics were improved.

Figure 4:
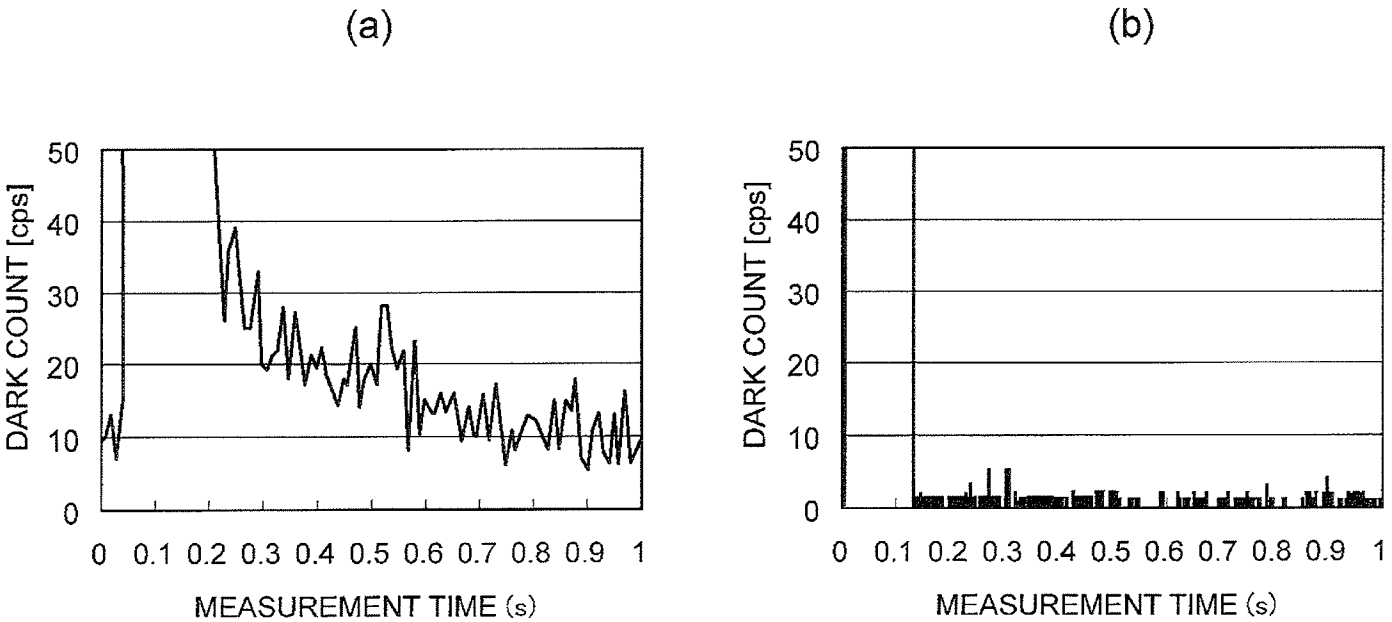
FIG. 4 is a drawing showing the measurement results of dark count attenuation characteristics of electron tubes according to Example and Comparative Example.

FIG. 4 is a drawing showing the measurement results of dark count attenuation characteristics of electron tubes according to Example and Comparative Example. The measurement shown in the same drawing was to evaluate the dark count attenuation characteristics with the electron tube using the insulating substrates without formation of the electrical resistance film on each ceramic base (Comparative Example: cf. FIG. 4(*a*)) and with the electron tube using the insulating substrates wherein the electrical resistance film was formed so as to cover the entire area of each ceramic base (Example: cf. FIG. 4(*b*)).

The dark count attenuation was evaluated by measuring a fall time of output upon interruption of incident light. The shorter this fall time of output, the better the dark count attenuation characteristics. As shown in FIG. 4(*a*), the dark counts of the sample of Comparative Example showed about 10 counts per second even after a lapse of one second from interruption of incident light. In contrast to it, as shown in FIG. 4(*b*), the dark counts of the sample of Example showed almost zero count per second after a lapse of 0.15 second from interruption of incident light. Therefore, it was confirmed that in Example the fall of output was steep and thus the dark count attenuation characteristics were improved.

The present invention is not limited to the above embodiment. For example, the aforementioned embodiment showed the photomultiplier with the line focus type dynodes 11 as the electron tube 1 by way of illustration, but it is noted that the electrical resistance film 15 can also be applied to the electron tubes using the insulating substrate as an insulating holding portion like those with the box line type dynodes or the circular cage type dynodes and to the electron tubes wherein the insulating holding portion of a substantially spherical shape is arranged between tabular electrodes like those with multilayer dynodes such as metal channel dynodes or mesh dynodes. In the above embodiment, the electrical resistance film 15 was formed over the entire area of the base 14 in the insulating substrate 12, but from the viewpoint of improvement in hysteresis characteristics, the electrical resistance film 15 needs only to be formed at least on the holding surface 12*a* side of the base 14. Furthermore, in the above embodiment, ZnO was shown as the electrically conductive material to be used for formation of the electrical resistance film 15 by way of illustration, and examples of other electrically conductive materials applicable herein include $SnO_2$, $Ga_2O_3$, $In_2O_3$, NiO, CuO, $TiO_2$, $Cr_2O_3$, and so on. On the other hand, insulating materials applicable herein include MgO, $SiO_2$, $HfO_2$, and so on, as well as $Al_2O_3$ described above.

REFERENCE SIGNS LIST

1 electron tube; 2 housing; 4 multiplication unit; 9 photocathode; 11 dynodes (electrodes); 12 insulating substrate (insulating holding portion); 12*a* holding surface; 14 base; 15 electrical resistance film.

The invention claimed is:

1. An electron tube comprising:

a plurality of electrodes;

an insulating holding portion for holding the electrodes in an electrically isolated state; and a housing for housing the electrodes and the insulating holding portion, wherein the insulating holding portion has:

a base comprised of an insulating material; and an electrical resistance film formed on an electrode holding surface in the base, and wherein the electrical resistance film has a stacked structure of an electrically insulating layer and an electrically conductive layer formed by an atomic layer deposition method.

2. An electron tube comprising:

a plurality of electrodes;

an insulating holding portion for holding the electrodes in an electrically isolated state; and a housing for housing the electrodes and the insulating holding portion, wherein the insulating holding portion has:

a base comprised of an insulating material; and an electrical resistance film formed on an electrode holding surface in the base, and wherein the electrical resistance film has a mixed structure of an electrically insulating material and an electrically conductive material formed by an atomic layer deposition method.

3. The electron tube according to claim 1, wherein the electrical resistance film is formed across an entire area of the base.

4. The electron tube according to claim 1, wherein the electrically insulating material used for formation of the electrical resistance film is a metal oxide.

5. The electron tube according to claim 1, wherein the electrically conductive material used for formation of the electrical resistance film is a metal oxide.

6. The electron tube according to claim 1, comprising:

a photocathode for converting incident light into photoelectrons, wherein the electrodes are electrodes of a multiplication unit for multiplying the photoelectrons generated in the photocathode.

7. The electron tube according to claim 2, wherein the electrical resistance film is formed across an entire area of the base.

8. The electron tube according to claim 2, wherein the electrically insulating material used for formation of the electrical resistance film is a metal oxide.

9. The electron tube according to claim 2, wherein the electrically conductive material used for formation of the electrical resistance film is a metal oxide.

10. The electron tube according to claim 2, comprising:

a photocathode for converting incident light into photoelectrons, wherein the electrodes are electrodes of a multiplication unit for multiplying the photoelectrons generated in the photocathode.

* * * * *